United States Patent [19]

Hamisch, Jr. et al.

[11] Patent Number: 4,690,317

[45] Date of Patent: Sep. 1, 1987

[54] HAND-HELD TAG ATTACHER

[75] Inventors: Paul H. Hamisch, Jr., Franklin; James A. Makley; Robert M. Pabodie, both of Dayton; Larry D. Strausburg, Waynesville, all of Ohio

[73] Assignee: Monarch Marking Systems, Inc., Dayton, Ohio

[21] Appl. No.: 773,480

[22] Filed: Sep. 6, 1985

[51] Int. Cl.[4] ..... B65C 7/00; A43D 69/00

[52] U.S. Cl. ..... 227/67; 221/213; 221/241; 221/253; 221/242

[58] Field of Search ..... 227/67, 120, 121, 128, 227/76, 19, DIG. 1; 221/215, 232, 242, 213, 241, 272

[56] References Cited

U.S. PATENT DOCUMENTS

| | | | |
|---|---|---|---|
| 2,701,662 | 2/1955 | Smith | 221/241 X |
| 3,392,881 | 7/1968 | Eriksen | 221/213 |
| 3,708,087 | 1/1973 | Schonthal | 221/272 X |
| 3,887,107 | 6/1975 | Grushon | 221/241 |
| 4,323,183 | 4/1982 | Duchin | 227/67 |
| 4,427,008 | 1/1984 | Transuf | 227/DIG. 1 |
| 4,448,194 | 5/1984 | DiGiovanni et al. | 227/67 X |
| 4,557,472 | 12/1985 | Hannon | 221/241 X |
| 4,610,384 | 9/1986 | Duchin | 227/67 |
| 4,610,385 | 9/1986 | Duchin | 227/67 |

FOREIGN PATENT DOCUMENTS

| | | |
|---|---|---|
| 91410 | 10/1953 | European Pat. Off. . |
| 116544 | 9/1980 | Japan . |

*Primary Examiner*—Paul A. Bell

*Attorney, Agent, or Firm*—Joseph J. Grass

[57] ABSTRACT

There is disclosed a hand-held tag attacher for attaching tags to merchandise and the like. The attacher includes a hopper for holding a stack of tags to be attached, a tag feeder for feeding one tag at a time into alignment with a needle at an attaching position, mechanism for advancing the needle through the tag at the attaching position, a push rod for pushing a bar of a fastener through the needle, and means for feeding fasteners one-by-one to the needle, wherein the tag feeder, the needle advancing mechanism, the push rod and the fastener feeding means operate in sequence by one-hand operation by the user.

20 Claims, 28 Drawing Figures

256
257
258
259
262'
261
262
263
260
178
165
164
288
287
289
285
286
291
234'
255
130
129
132
139
135
136
137
134
133
131
146
150
151
148
145
149
198
147
154
187'
155
177
163
174
159
179'
162
192
196
193
197
160
175
137
144
143
161
158
167
166
172
173
170
168
171
169

171
168
169
TE
136
141
140
135
131
137
130
138
281
273
153
150
151
145
149
147
271
279
272
146
154
143
176
144
142'
142
157
156
160
155
152
148

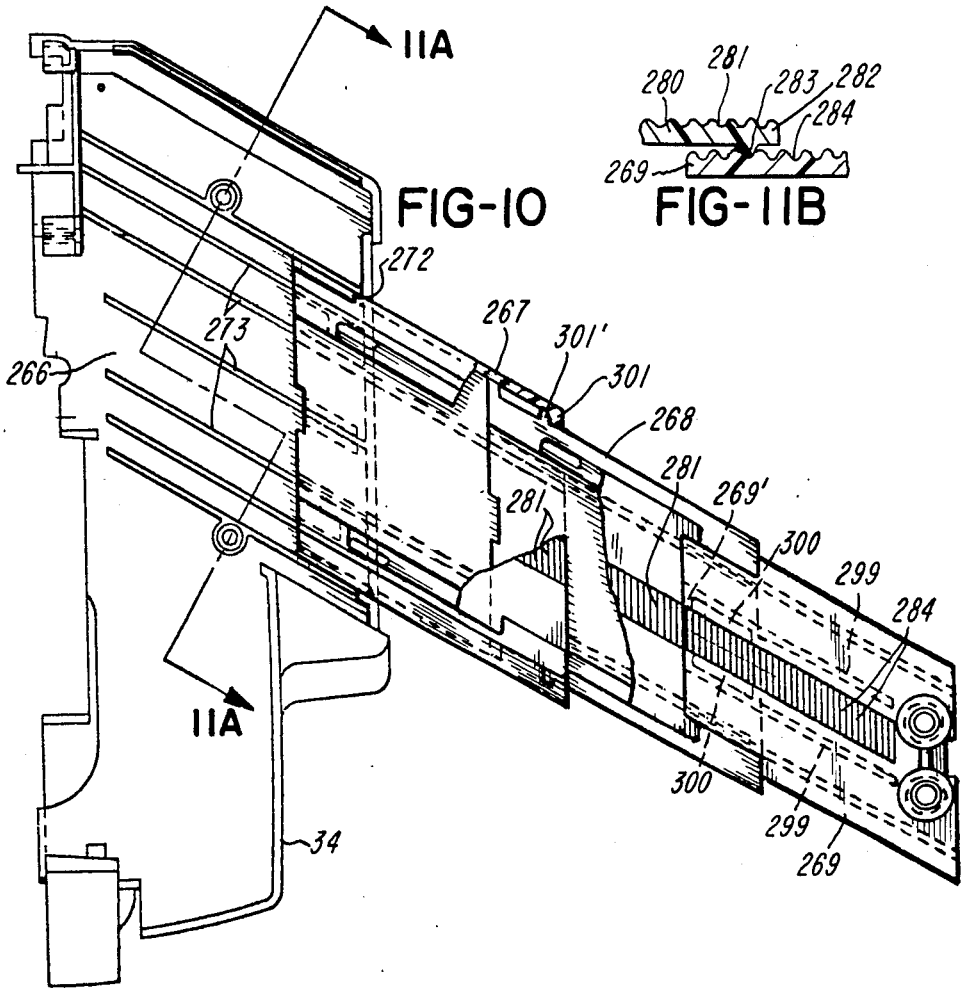
FIG-10
FIG-11B
FIG-11A
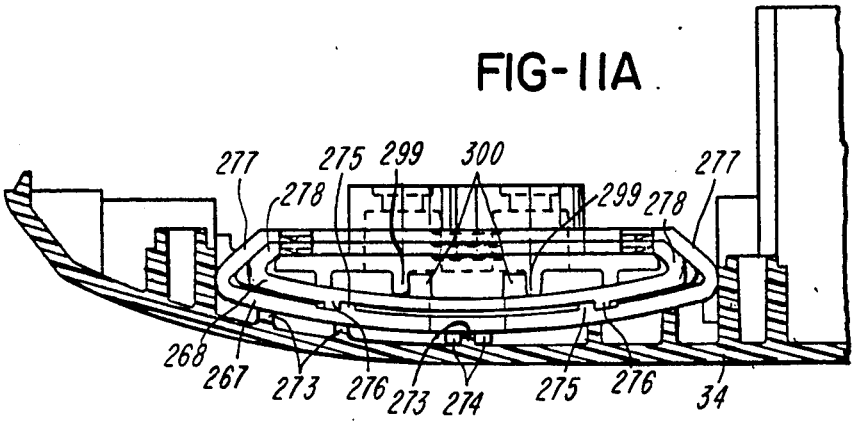

FIG-12
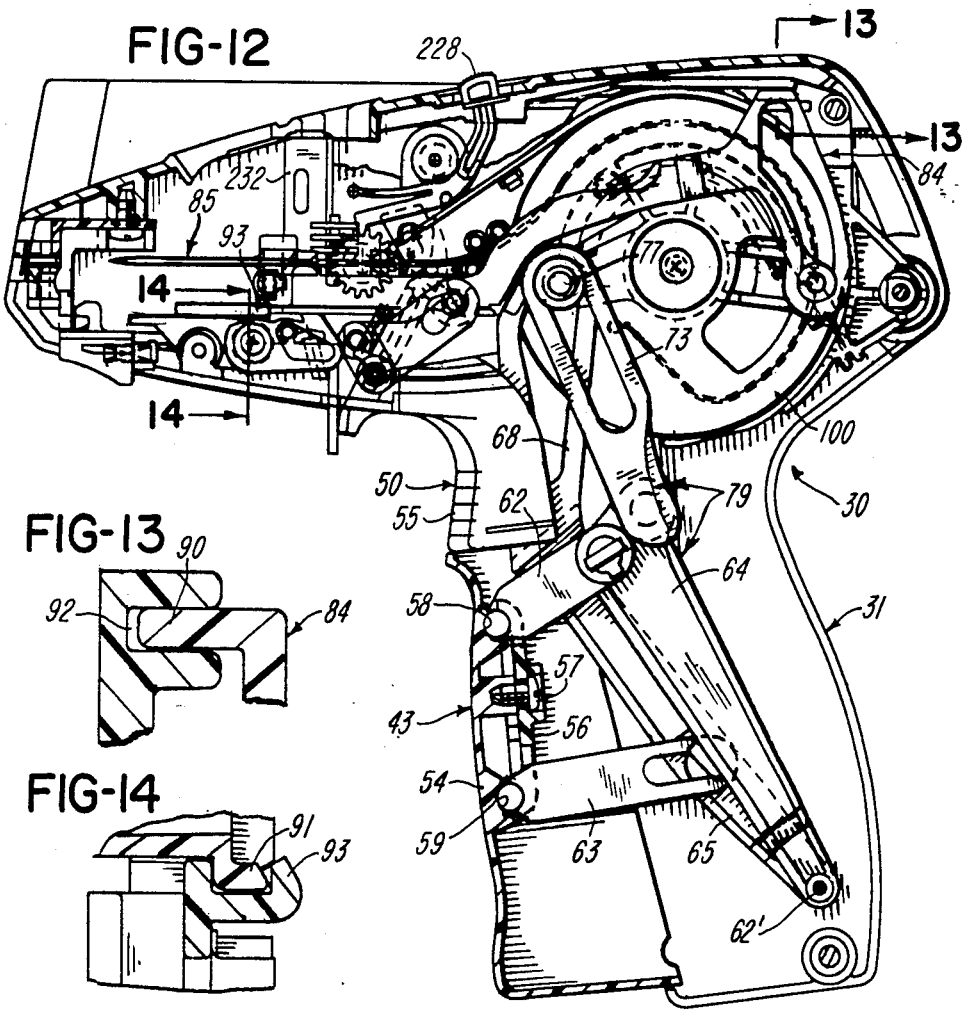
FIG-13
FIG-14
FIG-15
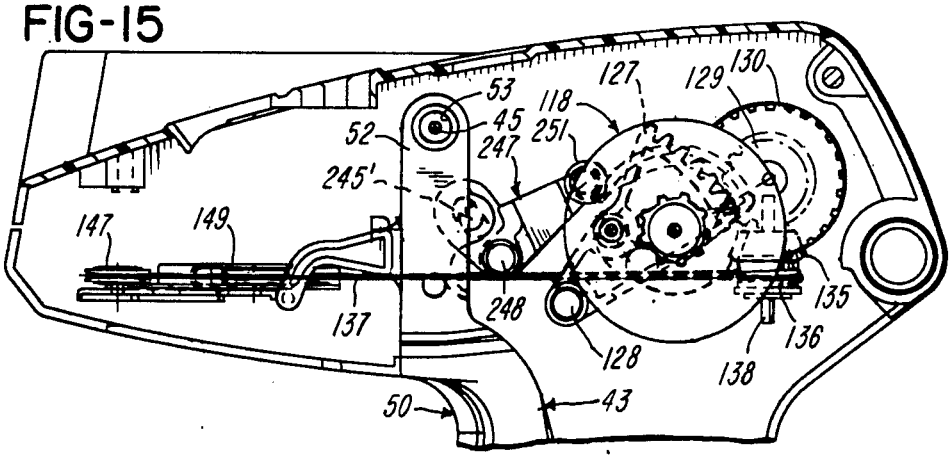

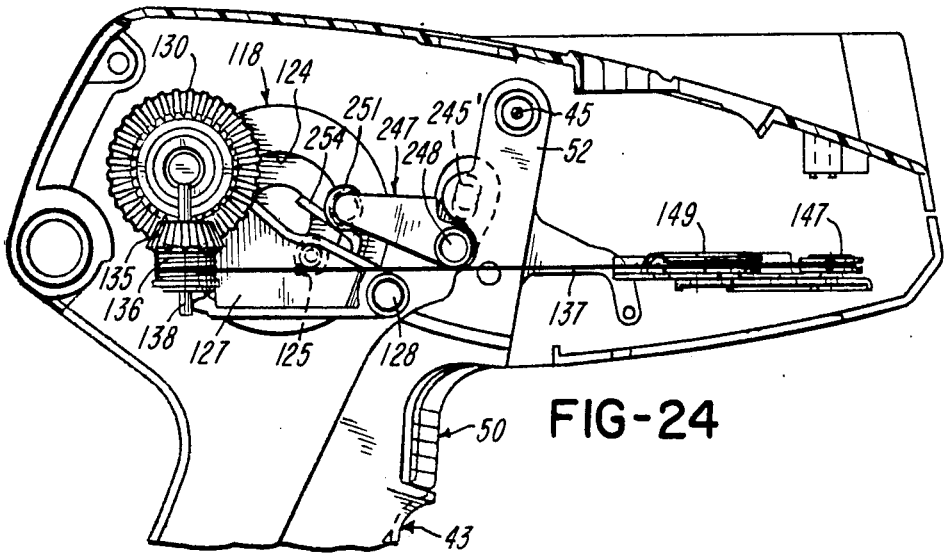
FIG-24
FIG-25
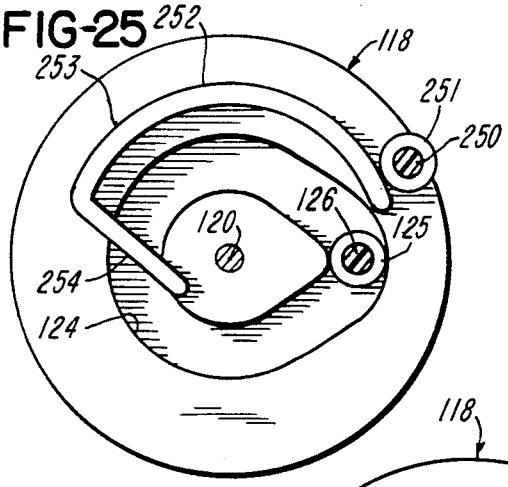
FIG-26
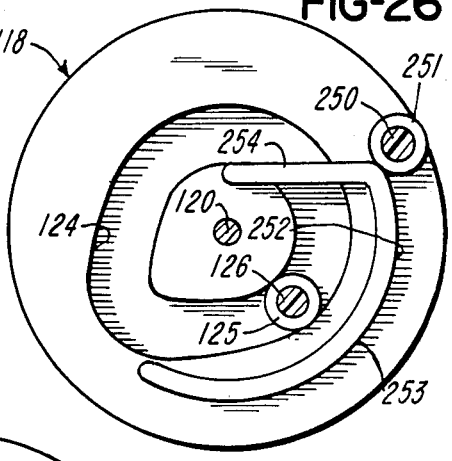
FIG-27
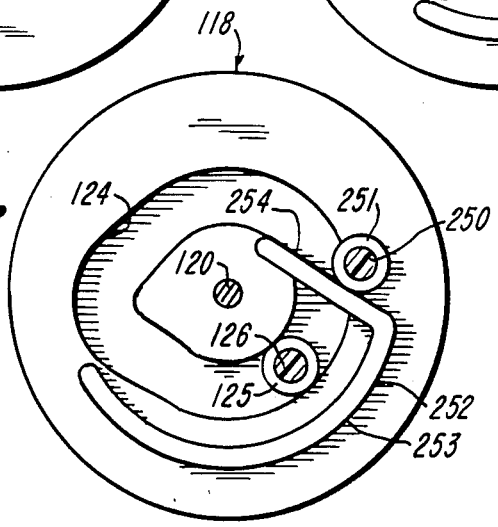

HAND-HELD TAG ATTACHER

BACKGROUND OF THE INVENTION

1. Field of the Invention

This invention relates to the field of hand-held tag attachers.

2. Brief Description of the Prior Art

The following are acknowledged to constitute prior art in the United States: U.S. Pat. No. 4,323,183 to Daniel Duchin granted Aug. 6, 1982; U.S. patent application of Daniel Duchin, Ser. No. 654,062 filed Sept. 25, 1984; now U.S. Pat. No. 4,610,384; U.S. patent application of Larry D. Strausburg, Ser. No. 654,333 filed Sept. 25, 1984; European application publication No. 009140 of Bengt Luden filed Mar. 10, 1983; Japanese published application No. 54-20935, patent laid-open No. 55-116544, laid open Sept. 8, 1980.

SUMMARY OF THE INVENTION

It is an object of the invention to provide an improved hand-held tag attacher with respect to the above-mentioned developments of Daniel Duchin and Larry D. Strausburg.

It is a further object of the invention to provide a reliable, essentially all-plastic hand-held tag attacher which is manufacturable at relatively low cost and which is highly productive in that it is capable of attaching tags to a large number of garments and the like in a short period of time.

BRIEF DESCRIPTION OF THE DRAWINGS

FIG. 10 is a fragmentary top plan view of the hopper with its end guide structure;

FIG. 11A is a sectional view taken along line 11A—11A of FIG. 10;

FIG. 11B is a fragmentary sectional view taken along line 11B—11B of FIG. 10;

FIG. 12 is a partly broken away front elevational view of the tag attacher shown in its home or initial position;

FIG. 13 is a fragmentary sectional view taken generally along line 13—13 of FIG. 12;

FIG. 14 is a fragmentary sectional view taken along line 14—14 of FIG. 12;

FIG. 15 is a partly broken away front elevational view showing mainly the mechanism for moving the tag feeder, in its home position;

FIG. 24 is a rear elevational view, showing the first and second actuators moved to their fully actuated positions;

FIG. 25 is a rear elevational view of a cam and cam rollers in their initial positions;

FIG. 26 is a view similar to FIG. 25, but showing the cam rotated to a position in which the first actuator has moved to its fully actuated position; and FIG. 27 is view similar to FIG. 25, but showing the cam rotated to a position in which the first and second actuators have moved to their fully actuated positions.

DESCRIPTION OF A PREFERRED EMBODIMENT

Figure 1:
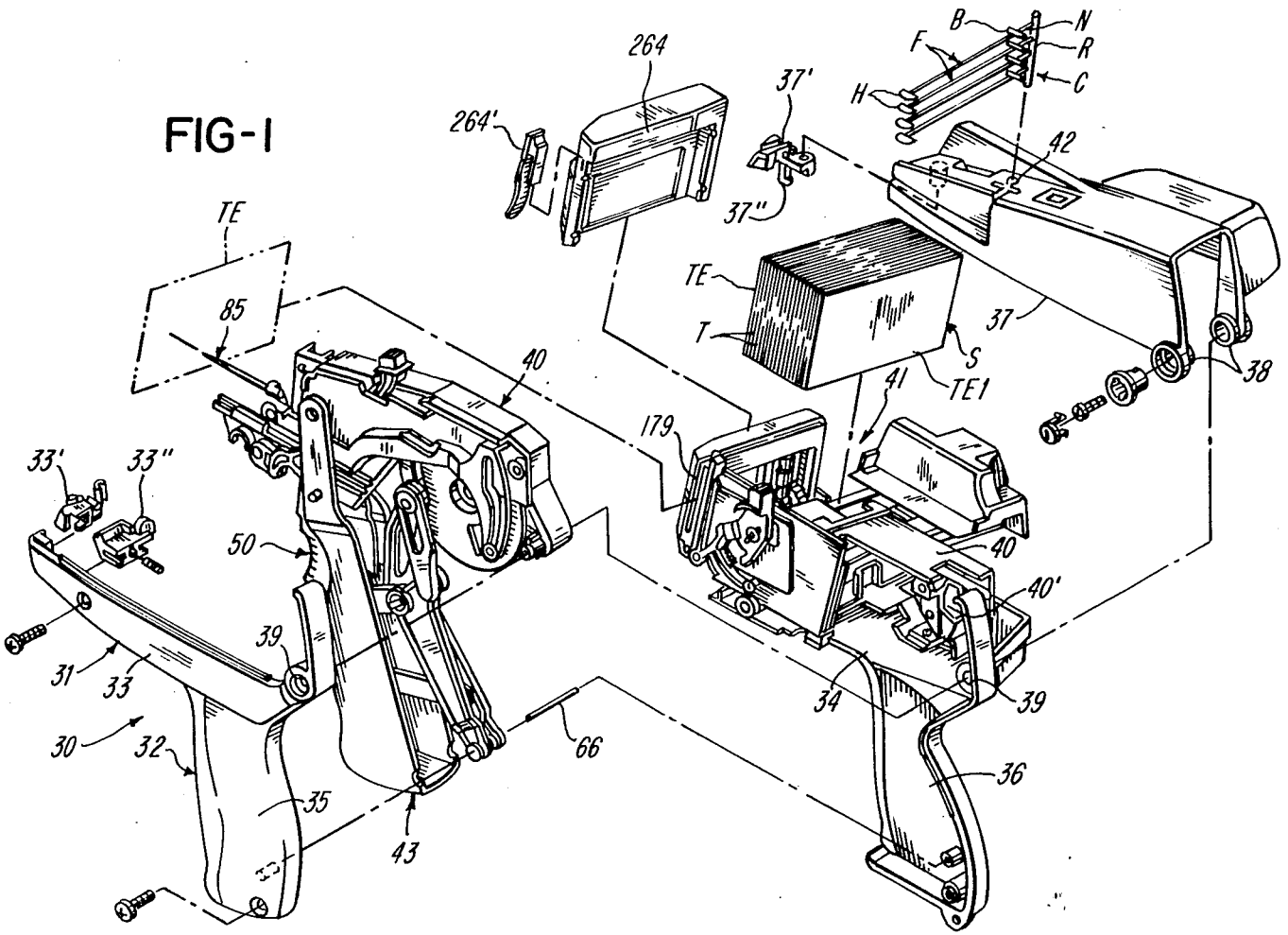
FIG. 1 is a partly exploded perspective view of a hand-held tag attacher in accordance with a preferred embodiment of the invention, together with a stack of tags and a clip of fasteners.

With reference to FIG. 1 initially, there is shown a hand-held tag attacher generally indicated at 30. The attacher 30 includes a frame body or housing generally indicated at 31 having a handle generally indicated at 32. The housing 31 includes side-by-side front and rear housing sections 33 and 34. The handle 32 includes handle sections 35 and 36. The housing 31 also includes a top housing section 37 pivotally mounted to the front and rear sections 33 and 34 by opposed annular flanges 38 received in holes 39. The housing 31 mounts a subframe 40 disposed between housing sections 33 and 34 and below housing section 37. A guide plate 40' is disposed between the subframe 40 and the housing section 33. The housing section 37 mounts an upper needle guide 37' and the housing section 33 mounts a lower needle guide 33'. The guide 37' includes a toothed latch member 37'' which is cooperable with a toothed spring-loaded latch 33'' slidable on the housing section 33. The housing section 34 includes a hopper generally indicated at 41 for receiving a stack S of tags T. The hopper 41 is shown to be inclined to the rear at an angle of about 30° with respect to a perpendicular to the longitudinal axis of the apparatus 30 to facilitate use of the apparatus as disclosed in the above-mentioned Strausburg patent application. The attacher 30 attaches tags T by means of fasteners generally indicated at F. The fasteners F are arranged in a clip C. Each fastener F includes a bar section B and a button or head section H joined by a filament or thread section T. Connectors or necks N connect respective bar sections B to a common rod R. The fasteners F are inserted through a slot 42 in the housing section 37.

Figure 2:
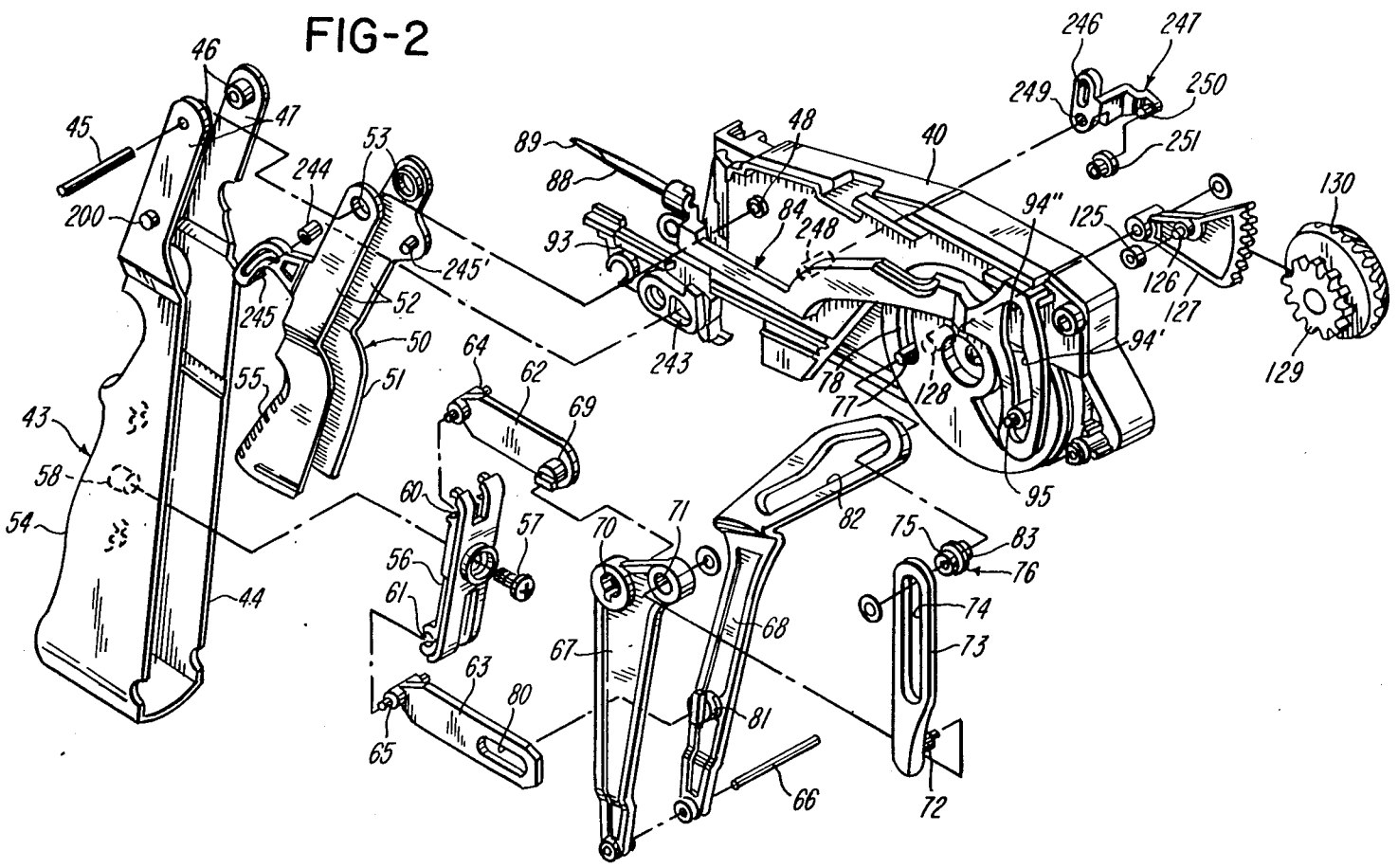
FIG. 2 is a partly exploded perspective view of certain component shown in assembled form in FIG. 1.

FIG. 2 shows a first actuator generally indicated at 43 in the form of a lever 44 pivoted on a pin 45 passing through tubular members 46 in spaced arms 47. The pin 45 is secured in a hole 48 in a subframe 40. A second actuator generally indicated at 50 in the form of a lever 51 has a pair of spaced arms 52 having holes 53 in which tubular members 46 are received The actuator 50 is thus pivotally mounted on and with respect to the actuator 43. The actuator 43 has a finger-engageable portion 54 engageable by the user's middle, ring and small fingers of one hand and the actuator 50 has a finger-engageable portion 55 engageable by the user's index finger of the same hand. The handle 32 is held against the palm of the user's same hand. A retainer 56 is secured in the attacher 43 by a screw 57 received in a boss 58. The actuator 43 has spaced concave recesses 58 and 59 (FIG. 12) and the retainer 56 has spaced recesses 60 and 61 (FIG. 2). Links 62 and 63 have respective pins 64 and 65 received in respective pairs of recesses 58 and 60 and 59 and 61 so that the links 62 and 63 are free to pivot relative to the actuator 43. A pin 66 pivotally mounts a toggle link 67 and a drive member 68 The link 62 includes a pin 69 received in a hole 70 in the toggle link 67. The toggle link 67 has a hole 71, spaced from the hole 70, which receives a pin 72 on a toggle link 73. The toggle link 73 has a elongate slot 74 which receives a reduced-diameter portion 75 of a roller generally indicated at 76. The roller 76 receives a pin 77 shown bottomed at one end 115 of a slot 78 for purposes to be described hereafter. The toggle links 67 and 73 comprise a toggle mechanism generally indicated at 79 in FIG. 12 acted on by the link 62. The link 63 has a elongate slot 80 which receives a pin 81 on the drive member 68. The drive member 68 has an elongate slot 82 which receives reduced section 83 of the roller 76

Figure 3:
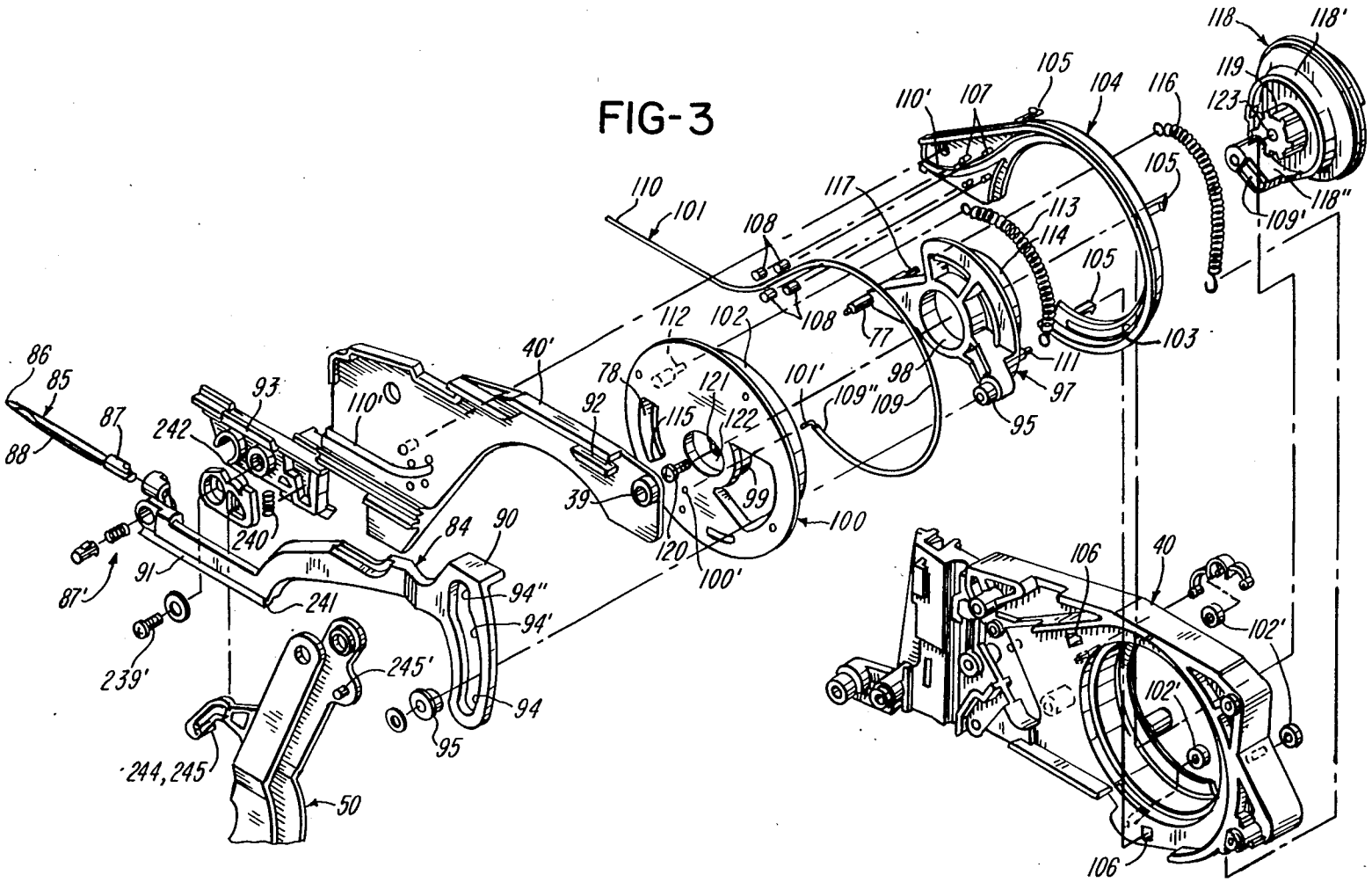
FIG. 3 is an exploded perspective view of other components shown in assembled form in FIGS. 1 and 2.

With reference to FIGS. 2 and 3, there is shown a slide or needle carrier generally indicated at 84 mounting a needle generally indicated at 85 for straight line reciprocating movement. The needle 85 is of a type having a pointed end 86 and an enlarged portion 87. The enlarged portion 87 is mounted in the needle carrier 84 and is removably retained in position by a retainer generally indicated at 87'. The needle 85 has an elongate side opening 88 communicating with an elongate open ended bore 89. The slide 84 is guided by tongues 90 and 91 fitting in respective grooves 92 and 93 (see also FIGS. 13 and 14). The slide 84 has a cam groove 94 for receiving a roller 95. The roller 95 is received on a stud 96 on an oscillating member generally indicated at 97. The member 97 has a central annular hole 98 received about an annular tubular portion 99 of an annular member generally indicated at 100 for mounting a push rod 101. The push rod 101 is composed of a tightly wound flexible member wrapped partly about and in contact with annular outer surface 102 of the annular member 100. Bent end portion 101' of the push rod 101 is received in a hole 100' in the member 100. A portion 109 of the push rod 101 is confined in space between the surface 102 and annular inner surface 103 of a guide generally indicated at 104. The guide 104 is snap connected to the subframe 40 by prongs 105 fitting into snap sockets 106. The guide 104 mounts four pins 107 which in turn mount four guide rollers 108. The guide rollers 108 assist in guiding the push rod 101 as it makes the transition between the curved portion 109 and a straight portion 110. The straight portion 110 is guided in opposed guides 110' in respective guide 104 and guide plate 40'. Rollers 102' in rolling contact with the annular surface 102 rotatably support the oscillating annular member 100.

Figure 5:
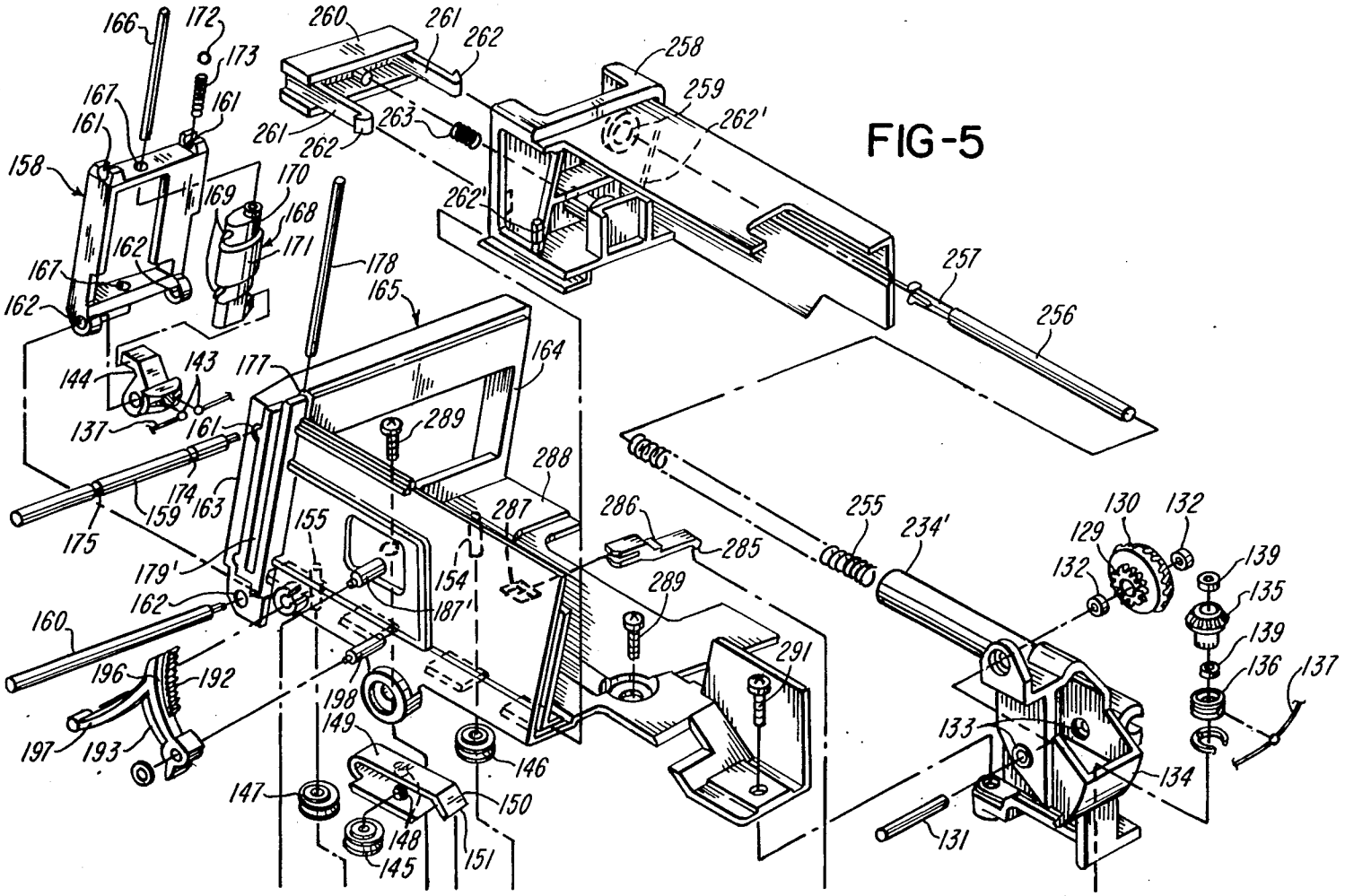
FIGS. 5 and 6 are perspective views which, taken together, comprise respective upper and lower portions of a hopper and associated mechanisms.
Figure 6:
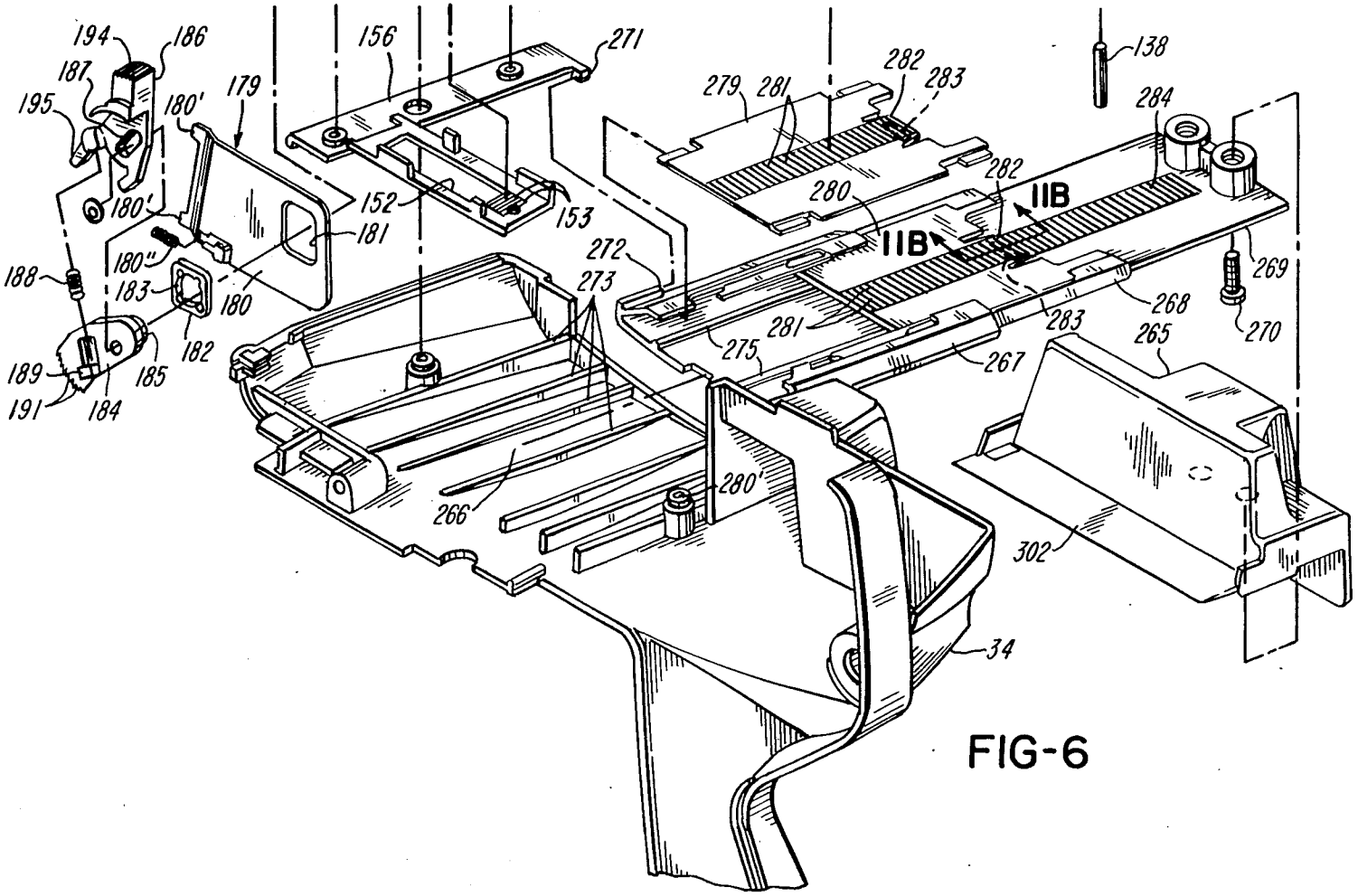

The annular member 97 has a post 111 and the annular member 100 has a post 112. Opposite end portions of a tension spring 113 are connected to the posts 111 and 112. The spring 113 lies in contact with annular surface 114 of the member 97. The spring 113 urges the pin 77 on the member 97 against the bottom 115 of the slot 78. Another tension spring 116 is relatively strong and serves as a return spring for all the moving parts of the attacher 30 which were actuated by operation of actuators 43 and 50. The return spring 116 is connected at one end portion to the subframe 40 and at its other end portion to a pin 117 aligned with the pin 77. The spring 116 is wrapped partly about annular surface 118' of a cam 118. The cam 118 has a lug 118'' keyed to the member 100 and has a groove 109' for capturing end portion 109'' of the curved portion 109. The cam 118, best shown in FIGS. 25 through 27, has a generally annular shaft portion 119 rotatably received in tubular portion 99. A screw 120 passes through a hole 121 in a wall 122 and is threaded into a hole 123 in the shaft portion 119. The screw 120 and a key (not shown) fix the member 100 and the cam 118 against relative rotation. The cam 118 has a cam groove 124 in which a follower roller 125 is captive. In the FIG. 25 position, namely, the home position, the roller 125 is at the high point in the cam groove 124. The roller 125 is rotatable on a pin 125 carried by a gear sector 127. The gear sector 127 is pivotal on a pin 128 mounted on the subframe 40. The gear sector 127 meshes with a gear 129 formed integrally with a bevel gear 130. With reference to FIG. 5, the one-piece gears 129 and 130 are secured to a shaft 131 mounted in spaced bushings 132. The bushings 132 are seated in spaced apart openings 133 in a gear box 134. The bevel gear 130 meshes with a bevel gear 135 keyed to a drum 136. The drum 136 is coupled to a cable 137. The gear 135 and the drum 136 are rotatable on a shaft 138 (FIG. 6) mounted in the gear box 134 on bearings 139.

Figures 7, 8, 9:
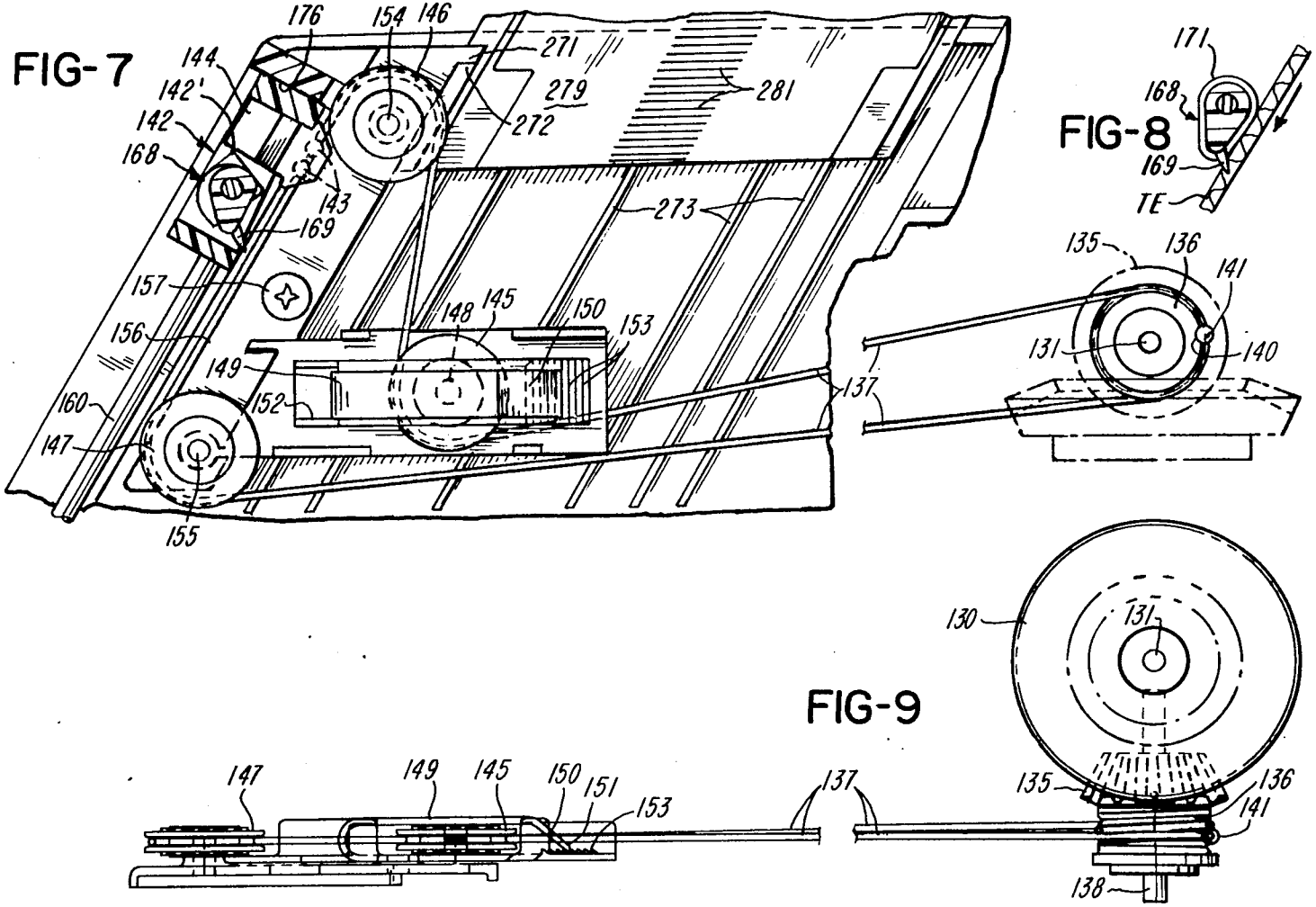
FIG. 7 is a fragmentary top plan view of the hopper.
FIG. 8 is a fragmentary view showing the manner in which a feed pin and a frictional member cooperate with the tag to move the tag in the advancing or feeding direction.
FIG. 9 is a fragmentary front elevational view of the mechanism for moving the tag feeder.

With reference to FIGS. 7 and 9 in particular, the drum 136 is shown to have a notch 140 for receiving a ball 141 secured to the cable 137. With the ball 141 in the notch 140, a tag feeder generally indicated at 142 is at the home position shown in FIG. 7 when the roller 125 is in the position shown in FIG. 25. Each end of the cable 137 has a ball 143 captive in a driver 144. The cable 137 passes one and one-half times about the drum 136 and partly about pulleys 145, 146 and 147. The pulley 145 is adjustably mounted so that the cable 137 can be under the proper tension. The pulley 145 is rotatable about a pin 148 mounted in a slide 149 having a flexible resilient member 150 terminating at a tooth 151. The slide 149 is slidably guided in a slot 152. The slide 149 is moved to the left in FIG. 7 to increase the tension on the cable 137, and vice versa The tooth 151 cooperating with the selected grooves 153 holds the slide 149 in the selected position. The pulleys 146 and 147 are rotatably mounted on pins 154 and 155 mounted to a plate 156. The plate 156 is secured to the housing section 34 by a screw 157.

With reference to FIG. 5, there is shown a generally rectangular slide generally indicated at 158 slidably mounted on spaced parallel shafts 159 and 160. The shafts 159 and 160 are secured in respective pairs of holes 161 and 162. End portions of the shafts 159 and 160 are received in parallel members 163 and 164 of a rectangular frame member 165 of the frame section 34. A shaft 166 is snugly received in aligned holes 167. The shaft 166 passes through and oscillatably mounts a tag engaging member generally indicated at 168. The member 168 includes a pair of spaced pointed pins 169 carried eccentrically by a hub member 170. A sleeve member 171 composed of a high friction preferably elastomeric material is received about the hub member 170 between the pins 169. The sleeve member 171 is shown in FIGS. 5 and 8, but is omitted in FIG. 7 for clarity. When the tag engaging member 168 has rotated to the position shown in FIG. 8, the pins 169 have penetrated or impaled the endmost tag TE slightly and the frictional sleeve member 171 has moved into frictional contact with the endmost tag TE. The sleeve 171 also limits the depth of penetration of the pins 169.

With reference to FIG. 7, counterclockwise rotation of the drum 136 will move the driver 144 against surface or face 142' of the tag engaging member 168 to cam the member 168 counterclockwise to the position shown in FIG. 8. Continued rotation of the drum 136 will cause the member 168 to advance the endmost tag TE from its initial position in the hopper 41 to an advanced position in which the tag TE is aligned with the needle 85 as shown in FIG. 1. As shown in FIG. 5, the slide 158 movably mounts a ball 172 urged by a spring 173 against the shaft 159. The shaft 159 has spaced annular grooves 174 and 175 to receive the ball 172 in both the initial and the advanced positions of the slide 158. The spring-urged ball 72 holds the slide 158 in the initial position as the driver 144 exerts force against face 142' to embed the points of the pins 169 assuredly into the tag TE. Continued movement of the driver 144 will overcome the detent force of the ball 172 in the groove 174 and will drive the slide 158 and the tag TE to the advanced position. Thereafter, rotation of the drum 136 in the clockwise direction will cause the driver 144 to act against the face 176 of the slide 158. Thereupon, there is clearance between the driver 144 and the face 142', and the member 168 is free to pivot clockwise (FIG. 7) so that the pins 169 are no longer impaled into the tag TE. The spring-urged ball 172 cooperates with the groove 175 to hold the slide 158 in the advanced position until the driver 144 has moved against face 176 and the retarding detenting force is overcome. This ensures that there will be enough clearance between the face 142' and the driver 144 before the slide 158 begins to move toward its home position.

With reference to FIG. 5, the member 163 has a open-sided bore 177 for receiving an annular roller 178. The roller projects outside the member 163 so that the tag TE rolls against the roller 178 as the tag TE is advanced. A gate generally indicated at 179 (FIG. 6) includes a gate member 180 having a pair of projections 180'. The roller 178 is spaced from the projections 180' to define a gap 179' between which the tag TE is advanced so that only one tag at a time can pass through the gap. The gap 179' is adjustable by sliding the gate member 180 in a straight line toward or away from the roller 178. The roller 178 is considered to a part of the gate 179. The gate member 180 has a square cutout 181 to receive a bearing 182 having a generally annular hole 183. A pivotal member 184 has an eccentric 185 received in the hole 183. An operator 186 is guided for movement relative to the member and has a slot 187 for receiving a 187'. A spring 188 acting on a projection 189 on the member 184 and on a projection 190 on the operator 186 urges the operator 186 upwardly and the member 184 counterclockwise to a position in which teeth 191 on the member 184 and teeth 192 on the member 193 engage to hold the gate member 180 in position. The gate member 180 is normally urged to the right in FIG. 6 by a compression spring 180". To change the gate adjustment the user manually depresses the operator 186 by applying finger pressure to top 194, and this causes projection 195 to ride on ridge 196 of the member 193 and to flex integral leaf spring 197 to enable the member 193 to pivot about pin 198 so that teeth 192 move clear of the teeth 191. The gate member 180 is urged generally to the right in FIG. 6 to open the gate gap 179', but the gate member 180 is moved toward the roller 178 by increased depression of the member 186.

Figure 4:
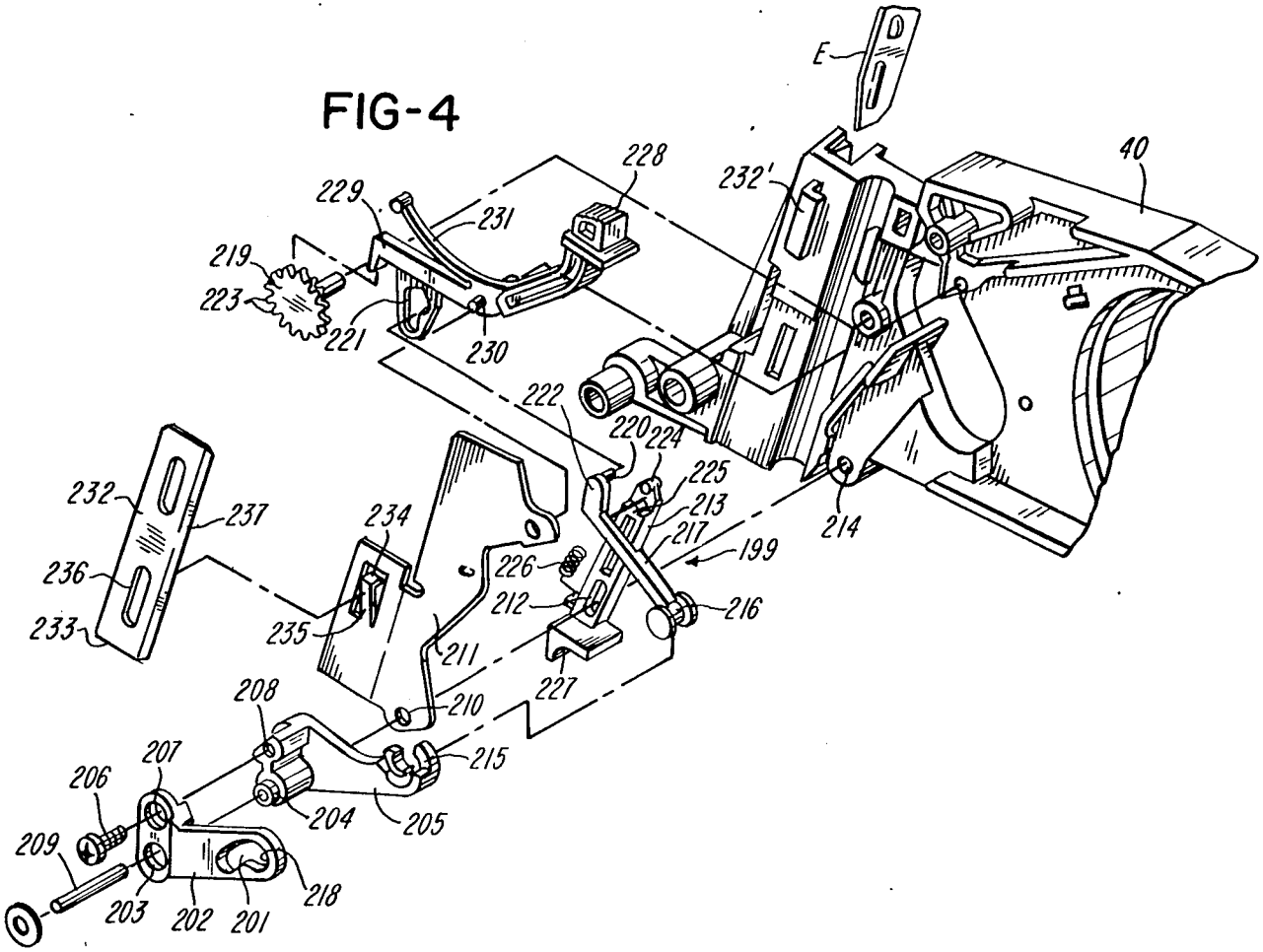
FIG. 4 is an enlarged exploded perspective view of showing a subframe, a fastener feeding mechanism and a knife assembly.
Figure 16:
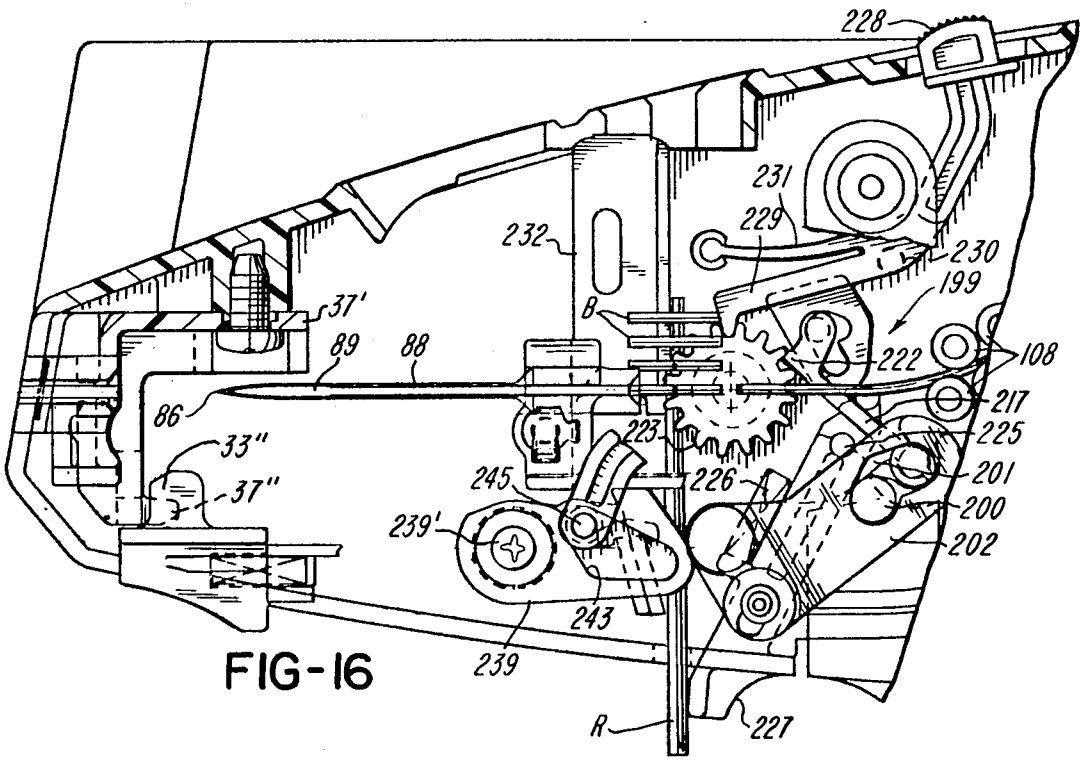
FIG. 16 is an enlarged fragmentary front elevational view showing components in the home or initial position.
Figure 17:
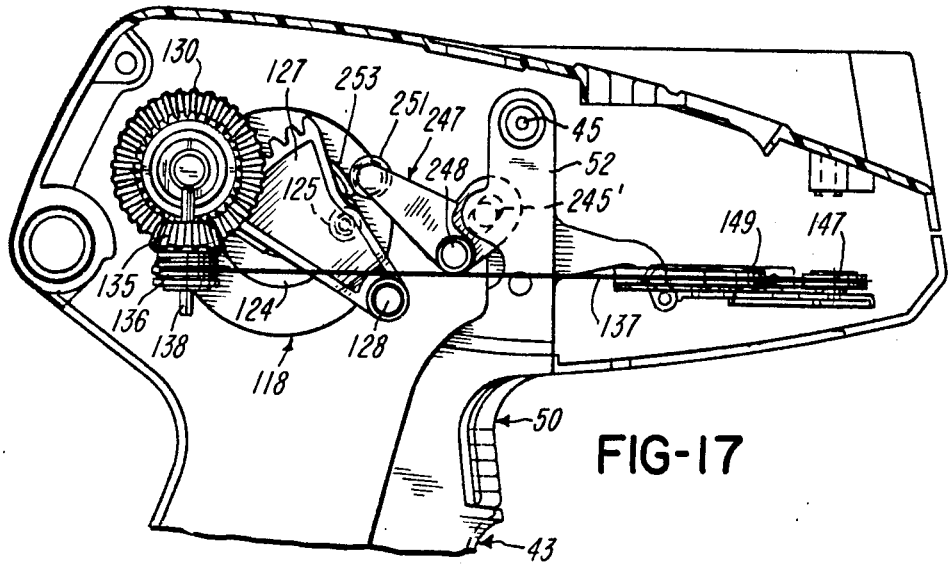
FIG. 17 is a partly broken away rear elevational view showing mainly the mechanism for moving the tag feeder, in the home position.
Figure 18:
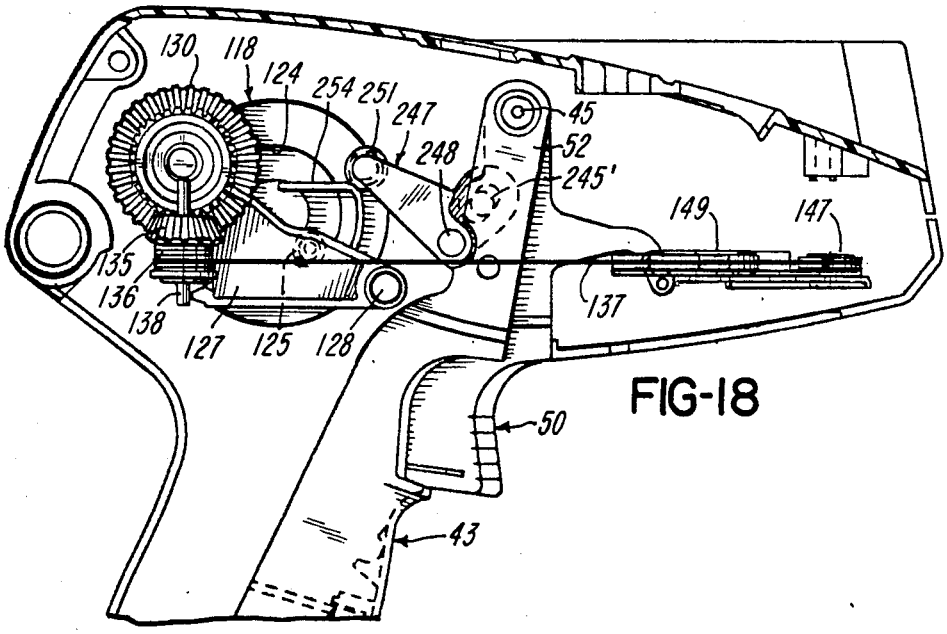
FIG. 18 is a view similar to FIG. 17, showing a first actuator as having moved to its fully actuated position but with a second actuator still in its home position.
Figure 23:
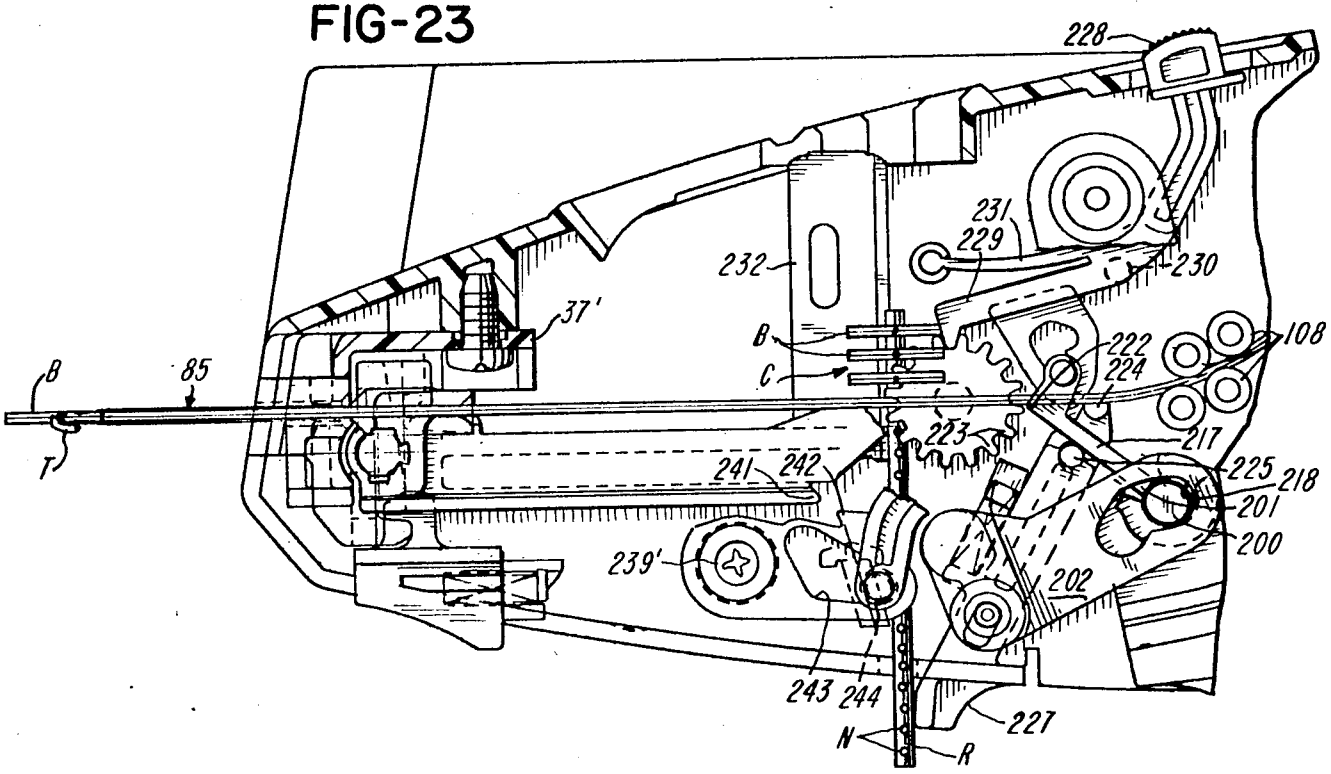
FIG. 23 is a view similar to FIG. 16, but with the first and second actuators moved to their fully actuated positions.

The clip C of fasteners F is advanced by feed mechanism generally indicated at 199 (FIGS. 4 and 16). Referring to FIG. 2, there is shown a drive pin 200 on the actuator 43. The drive pin 200 is also shown in FIGS. 16 and 23. The drive pin 200 is received in a heart-shaped slot 201 of a member 202. The member 202 has a hole 203 for receiving a tubular portion 204 of a member 205. A screw 206 passes through a hole 207 in the member 202 and is threaded into a bore 208 in the member 205. Thus, the members 200 and 205 pivot as a unit about a pin 209 passing through the hole 203, the tubular portion 204, a hole 210 in a plate 211, an elongate slot 212 in a member 213 and into a bore 214 in the subframe 40. The member 205 has a resilient C-shaped portion 215 into which annular portion 216 of a feed pawl 217 is snapped. Actuation of the actuator 43 causes the drive pin 200 to move in the slot 201 until the pin 200 abuts end 218 of the slot 201. In moving from the position shown in FIG. 16 to the position shown in FIG. 23, only part of the motion of the drive pin 200 is imparted to the pawl 217 because of lost-motion travel of the drive pin 200 in the slot 201. When the drive pin 200 has moved to the position shown in FIG. 23, the pawl 217 has moved out of contact with toothed feed wheel 219. As shown, the pawl 217 has a pin 220 received in a slot 221. When the actuator 43 is released the drive pin 200 moves the pawl 217 along a path so that tooth 222 engages the next successive tooth 223 of the wheel 219 to advance the clip C so that the next successive bar B is brought into alignment with the needle bore 89. As shown, the teeth 223 mesh with the connectors N which serve as a gear rack. The pawl 217 moves between two pins 224 and 225 on the member 213. The member 213 is urged downwardly (FIGS. 4 and 16) by a compression spring 226. To release feed pawl 217 from the feed wheel, button 227 is pushed upwardly against the action of the spring 226. This causes pin 225 to contact and move the feed pawl 217 out of contact with the toothed feed wheel 219. In order to remove the clip C, it is also necessary to depress not only the button 227 but also a button 228 which causes anti-backup pawl 229 to pivot about pin 230 against the bias of an integral leaf spring 231.

A knife 232 is inserted into the attacher 30 by an ejector device E only a fragment of which is shown in FIG. 4. As the knife 232 is inserted, edge 233 of the knife 232 contacts cam face 234 on a leaf spring 235 and causes the leaf spring 235 to deflect until slot 236 in aligned with the leaf spring 235 so that the leaf spring 235 is able to enter the slot 236, thereby holding the knife releasably in position. The leaf spring 235 is formed on the plate 211. Edge 237 of the knife 232 is immediately adjacent the bar B so that the bar B can be severed cleanly from the connector N. The knife 232 is retained by an L-shaped retainer 232' on the subframe. Thus, the connectors N remain attached to the rod R.

Figures 19, 20:
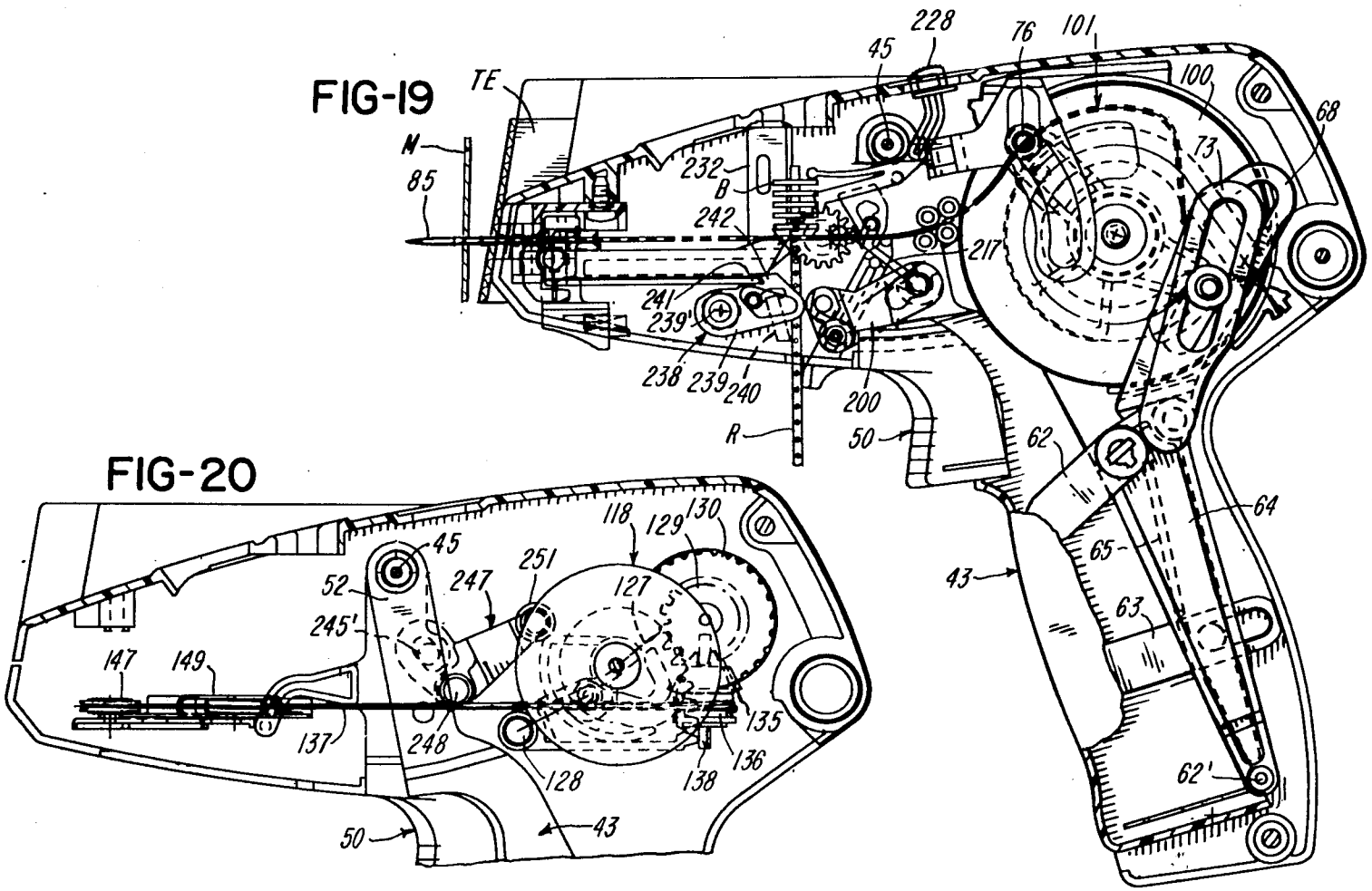
FIG. 19 is a view similar to FIG. 12, but showing the first actuator moved to its fully actuated position and showing the second actuator still in its home position.
FIG. 20 is a view similar to FIG. 15, but showing the first actuator moved to its fully actuated position and showing the second actuator still in its home position.
Figures 21, 22:
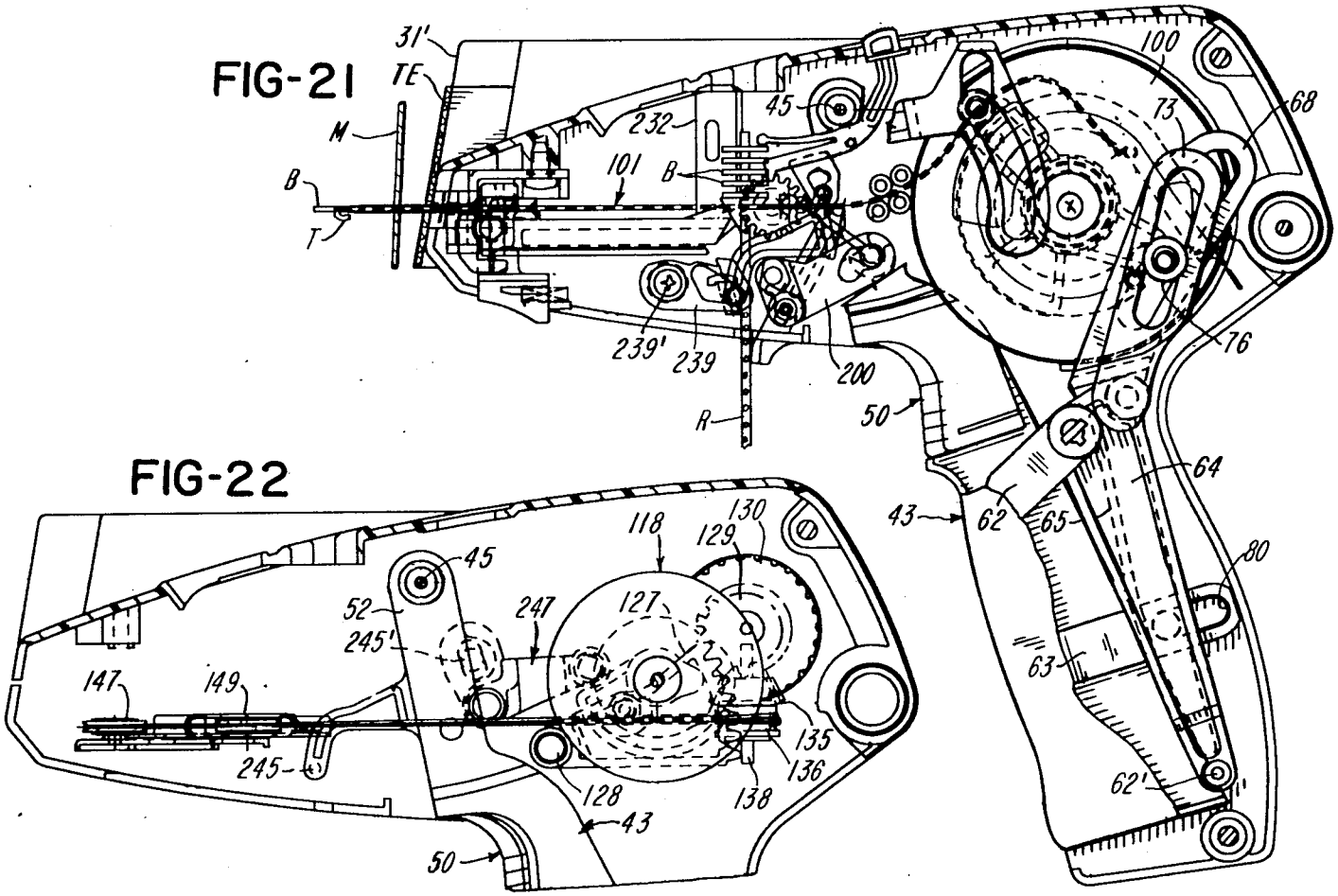
FIG. 21 is a view similar to FIG. 12, but showing the first and second actuators moved to their fully actuated positions.
FIG. 22 is a view similar to FIG. 15, but showing the first and second actuators moved to their fully actuated positions.

As shown in FIG. 12, the needle 85 is initially recessed in the housing 31. As the actuator 43 is operated, the needle carrier 84 moves to the left and when the needle carrier 84 reaches the position shown in FIG. 19, the needle 85 projects to its full extent out of the housing 31, wherein a latch generally indicated at 238 is operative to prevent return of the needle carrier 84. Thus, as the needle 85 is passed through merchandise M, the needle 85 cannot be pushed rearwardly into the housing 31. The latch 238 includes a movable latch member 239 urged counterclockwise (FIGS. 3 and 10) about a pivot 239' by a compression spring 240. The carrier 84 has a tooth 241 engaged by tooth 242 of the latch member 239. The latch member 239 has a slot 243 for receiving a roller 244. The roller 244 is received on a pin 245 on the second actuator 50. The latch member 239 is not released until the actuator 50 has moved from its unactuated position shown in FIGS. 10 and 19 to its fully actuated position shown in FIG. 23. As shown in FIG. 2, the actuator 50 carries a pin 245' received in an elongated slot 246 in a bellcrank 247. The bellcrank 247 is pivotal on a pin 248 projecting from the subframe 40. The pin 248 is received in a hole 249 in the bellcrank 247. The bellcrank 247 carries a pin 250 for mounting a roller 251. FIG. 25 shows the roller 251 in the home position, and FIG. 26 shows the roller 251 in the actuated position of the actuator 43. The cam 118 includes a cam member 252 having a dwell portion 253 and a ramp portion 254. Actuation of the actuator 50 causes the roller 251 to drive the cam 118 clockwise from the position shown in FIG. 26 to the position shown in FIG. 27. When the cam 118 is in the position of FIG. 27, the cam 118 has rotated the annular member 100 counterclockwise (FIGS. 3 and 19) to move the push rod 101 from the position shown in FIG. 19 to the position shown in FIGS. 21 and 23 in which the bar B is pushed out of the open end of the bore 89 at the point 86.

With reference to FIG. 5, the gear box 134 is shown to include a tubular housing 234' for a compression spring 255 and a plunger 256. The plunger 256 has an end portion 257 coupled to a pressure member 258 at an aperture 259. A pressure plate 260 is slidably coupled to the member 258 by guides 261 having hooks 262 engageable with surfaces 262' which limit the travel of the pressure plate 260. A compression spring 263 urges the pressure member 258 and the pressure plate 260 in opposite directions. The pressure plate 260 exerts pressure on the lower portion of the other endmost tag TE1 of the stack S to urge the endmost tag TE against the end wall 264. Front face 260' of the plate 260 is inclined at 10° with respect to the vertical to match the 10° upward and rearward slope of the end wall 264 (FIG. 1).

The ends of the tags T in the stack S abut against the gate member 180 and a wall member 265. The wall member 265 is adjustable relative to the gate member 180 by means of a stationary member 266 which forms part of the housing section 34 and movable telescoping members 267, 268 and 269. The wall member 265 is secured to the telescoping member 269 by screws 270, only one of which is shown. The plate 156 has a stop 271 cooperating with an abutment 272 to limit the extent to which the member 267 can move to the right in FIG. 6. The member 266 has guides 273 which guide the member 267 for straight line movement. The member 267 has guide members 274 which straddle one of the guides 273 (FIG. 11A). The member 267 has guides 275 which cooperate with guide members 276 to guide the member 268 for straight line movement. Also, the sides of the members 267 and 268 have mating flanges 277 and 278. Member 269 is disposed on top of member 268 but is captive below its flanges 278. Two identical cover members 279 and 280 are interlocked or otherwise suitably secured to respective detent members 267 and 268. The top surface of each detent member 279 and 280 has a series of grooves 281 and a spring detent finger 282 terminating at a detent tooth 283 (see also FIG. 11B). The member 269 has a top surface with a series of grooves 284. Detent tooth 283 on the member 280 is cooperable with grooves 284, and detent tooth 283 on the member 279 is cooperable with grooves 281 on the member 280. A detent tooth 285 (FIG. 5) on a spring finger 286 cooperates with a groove 281 of the member 279. The spring finger 286 is snapped into a cutout 287 in a plate 288. The plate 288 is secured to the stationary member 266 by a screw 289 received in boss 280'. A screw 289 secures the gear box 134 to the plate 288.

The underside of the member 269 has spaced guide members 299 which straddle guides 300 on the top side of the member 268. The guides 300 are short and cooperate with a transverse ridge 269' on the member 269 to prevent separation of the members 268 and 269. The member 267 has a stop 301 and the member 268 has a cooperating shoulder 301' to limit separational movement. The end guide 265 has a shelf 302 on which marginal end edges of the tags T rest. The stack S is contacted at opposed ends by and between the end wall 264 and the pressure plate 260 and by and between the gate member 180 and the wall member 265.

In operation, assume that there is a stack S of tags T in the hopper, that there is a clip C of fasteners F in the guideway 42, and that all moving components are in their home positions. The user now squeezes the actuator 43 and the toggle 79 is moved by link 62 to move the pin 77 counterclockwise (FIG. 12). In that the pin 77 bottoms against the end 115 of the slot 78, the member or drum 100 is rotated counterclockwise by the pin 77, thereby advancing the push rod 101 to push on an end of a bar B which is aligned with the needle bore 89. The cam 118 is driven through the same angle as the annular member 118 and the roller 125 moves rapidly down a ramp to effect movement of the tag feeder 142 to advance a tag immediately in front of the front end 31' at the position shown in FIGS. 19 and 21. As the links 73 and 67 become more and more inclined relative to each other, that is when pin 81 bottoms in slot 80, the lever 68 starts exerting force against the pin 77 to continue driving the annular member 100. Thereafter, as the roller 95 leaves dwell portion 94' of the slot 94 and enters portion 94'', the needle carrier 84 is moved to the position shown in FIG. 19 in which the needle 85 has made a hole in and passes through the tag TE. In the position shown in FIG. 19, the cam 118 has moved to the position shown in FIG. 26 and the push rod 101 has moved to a position in which the bar B is still in the needle bore 89 but near the pointed open end 86. In this position the latch 238 is latched in that the latch member 239 is in its counterclockwise position in which tooth 241 is engaged with tooth 242. Now by using the index finger to actuate the actuator 50, the roller 251 moves to drive the cam 118 from the position shown in FIG. 26 to the position shown in FIG. 27, thereby driving the push rod 101 to the position shown in FIG. 23 to eject the bar B from the needle 85. Near the end of the actuation of the actuator 50, the roller 244 cooperating in slot 243 of the latch member 239 moves the latch member 239 to the position shown in FIG. 23. As the user releases the actuators 43 and 50, the return spring 116 returns all moved components to their initial or home positions. As the annular member 100 returns, the push rod 101 returns to its initial position. As the annular member 97 returns, the needle carrier 84 moves to its home position. As the cam 118 rotates from the position shown in FIG. 27, through the position shown in FIG. 26 to the position shown in FIG. 25, the cable 137 moves to return the tag feeder 142 to its initial or home position shown in FIG. 7. The attacher 30 now ready to attach another tag T.

Mounted on the front of the end wall 264 is a resilient clip 264'. If it is desired to attach an additional tag or tags (now shown) to the merchandise at the same time the tag TE is attached, the additional tag or tags are attached by manually inserting the advanced needle 85 through the additional tag or tags and pivoting them to a position in which they are clamped between the end wall 264 and the clip 264'.

Other embodiments and modifications of the invention will suggest themselves to those skilled in the art, and all such of these as come within the spirit of this invention are included within its scope as best defined by the appended claims.

We claim:

1. A hand-held tag attacher for attaching tags to merchandise using fasteners, each fastener having a bar section and a button section joined by a filament section, the attacher comprising: an attacher body having a hopper adapted to receive a stack of tags and having a manually engageable handle, a needle having an elongate needle bore and an elongate side opening communicating with the needle bore, means for engaging an endmost tag in the stack, wherein the engaging means includes a non-impaling frictional member engageable with a facial area of the tag and a tag-impaling feed pin, driver means for moving the feed pin and the frictional member from ineffective positions out of feeding engagement with the endmost tag to an effective position in feeding engagement with the tag, for holding the feed pin and the frictional member in contact with the tag to advance the tag to an attaching position in alignment with the needle, means for advancing one bar section at a time into alignment with the needle bore, a push rod engageable with a bar section of a fastener for driving the bar section through the needle bore while it filament section extends through the side opening, and means including a manually operable actuator disposed at the handle for moving the driver means, the push rod and the bar section advancing means.

2. A hand-held tag attacher as defined in claim 1, including a rotatable shaft, means for securing the feed pin on the shaft, and wherein the frictional member is mounted on the shaft.

3. A hand-held tag attacher as defined in claim 1, wherein there is a pair of said feed pins, wherein the feed pins are spaced apart, and the frictional member is positioned between the feed pins.

4. A hand-held tag attacher as defined in claim 1, including a rotatable shaft, wherein there is a pair of said feed pins, wherein the feed pins are spaced apart, and wherein the frictional member includes a sleeve received about the shaft between the feed pins.

5. A hand-held tag attacher for attaching tags to merchandise using fasteners, such fastener having a bar section and a button section joined by a filament section, the attacher comprising: an attacher body having a hopper adapted to receive a stack of tags and having a manually engageable handle, a needle having an elongate needle bore and an elongate side opening communicating with the needle bore, means for feeding an endmost tag from the hopper to an attaching position in alignment with the needle bore, means for advancing one bar section at a time into alignment with the needle bore, a push rod engageable with a bar section of a fastener for driving the bar section through the needle bore while its filament section extends through the side opening, means including a manually operable actuator disposed at the handle for operating the feeding means, for moving the push rod to push the bar section through the needle and tag and for operating the bar-section advancing means in sequence, wherein the hopper includes a gate for allowing only the endmost tag to pass therethrough, a spring-urged pressure member acting on the opposite endmost tag for urging the stack toward the feeding means, a first end guide for an end edge of the stack adjacent the gate, a second end guide for the opposite end edge of the stack, means disposed in underlying relationship with respect to the stack for adjustably positioning the second end guide against said opposite end of the stack to accommodate tags of different lengths, wherein the gate includes roller means and a gate member cooperating with the roller means define a gap enabling passage of the endmost tag.

6. A hand-held tag attacher as defined in claim 5, wherein the roller means and the gate member are relatively adjustable to vary the size of the gap.

7. A hand-held tag attacher as defined in claim 6, including means for latching the roller means and the gate member in a selected adjusted position relative to each other. adapted to receive a stack of tags and having a manually engageable handle, a needle mounted to the body and having an elongate needle bore and an elongate side opening communicating with the needle bore, means for advancing one bar section at a time into alignment with the needle bore, a push rod engageable with a bar section of a fastener for driving the bar section through the needle bore while its filament section extends through the side opening, a tag feeder engageable with an endmost tag in the hopper for feeding the endmost tag from its position in the stack along a path to an attaching position in alignment with the needle, means for moving the bar section advancing means, the push rod and the tag feeder means through a cycle, means for movably mounting the needle relative to the attacher body between a retracted position in which the needle is out of the path and an extended position in which the needle extends through the tag, means responsive to the actuating means for moving the tag feeder to move a tag from the hopper into alignment with the needle, for moving the needle through the tag, for moving the push rod to push the bar section through the needle bore, and for moving the bar section advancing means through a cycle, and a clip on the body adjacent the needle for retaining an additional tag through which the needle has been inserted by the user when it is desired to attach an additional tag to the merchandise.

8. A hand-held tag attacher for attaching tags to merchandise using fasteners, each fastener having a bar section and a button section joined by a filament section, the attacher comprising: an attacher body having a hopper 9. A hand-held tag attacher for attacher for attaching tags to merchandise using fasteners, each fastener having a bar section and a button section joined by a filament section, the attacher comprising an attacher body having a hopper adapted to receive a stack of tags and having a manually engageable handle, a needle mounted to the body and having an elongate needle bore and an elongate side opening communicating with the needle bore, means for advancing one bar section at a time into alignment with the needle bore, a push rod engageable with a bar section of a fastener for driving the bar section through the needle bore while its filament section extends through the side opening, a tag feeder engageable with an endmost tag in the hopper for feeding the endmost tag from its position in the stack along a path to an attaching position in alignment with the needle, means for moving the bar section advancing means, the push rod and the tag feeder means through a cycle, means for movably mounting the needle relative to the attacher body between a retracted position in which the needle is out of the path and an extended position in which the needle extends through the tag, means responsive to the actuating means for moving the tag feeder to move a tag from the hopper into alignment with the needle, for moving the needle through the tag, for moving the push rod to push the bar section through the needle bore, and for moving the bar section advancing means through a cycle, wherein the moving means includes a cable connected to the tag feeder and pulley means for supporting the cable for movement along a path so that movement of the cable in one direction moves the tag feeder and hence the endmost tag to the attaching position and movement of the cable in the opposite direction returns the tag feeder, and wherein the moving means further includes a drum having a notch and the cable includes a ball received in the notch.

10. A hand-held tag attacher as defined in claim 9, wherein the moving means further includes gearing for moving the drum alternately in opposite directions.

11. A hand-held labeler as defined in claim 10, wherein the gearing includes a pair of meshing bevel gears, and a cam for operating the bevel gears.

12. A hand-held tag attacher for attaching tags to merchandise using fasteners, each fastener having a bar section and a buttom section joined by a filament section, the attacher comprising: an attacher body having a hopper adapted to received a stack of tags and having a manually engageable handle, a needle having an elongate needle bore and an elongate side opening communicating with the needle bore, means for feeding an endmost tag from the hopper to an attaching position in alignment with the needle bore, means for advancing one bar section at a time into alignment with the needle bore, a push rod engageable with a bar section of a fastener for driving the bar section through the needle bore while its filament section extends through the side opening, means including a manually operable actuator disposed at the handle for operating the feeding means, for moving the push rod to push the bar section through the needle and tag and for operating the bar section advancing means in sequence, wherein the hopper includes a gate for allowing only the endmost tag to pass therethrough, a spring-urged pressure plate acting on the opposite endmost tag for urging the stack toward the feeding means, a first end guide for an end edge of the stack adjacent the gate, a second end guide for the opposite second end edge of the stack, means for enabling selective positioning and holding of the second end guide against said opposite end of the stack to accommodate tags of different lengths, and wherein the positioning enabling and holding means includes at least two cooperable members disposed in underlying relationship with respect to the stack for holding the second end edge guide in a selected position.

13. A hand-held tag attacher as defined in claim 12, wherein the second end guide includes relatively movable members, one of the members having means defining a series of detent recesses and another of the members having a yieldable detent tooth cooperable with one of the recesses corresponding to the selected position of the second end guide.

14. A hand-held tag attacher as defined in claim 12, wherein the second end guide includes three relatively movable telescoping members, two of the members having means defining a series of detent recesses, and means including two yieldable detent teeth cooperable with a selected recess of both of the respective movable members.

15. A hand-held tag attacher as defined in claim 12, wherein the second end guide includes relative movable members, and cooperable means on the relatively movable members for guiding the relatively movable members for straight line movement.

16. A hand-held tag attacher as defined in claim 12 wherein there are four relatively movable members and wherein one of the members is stationary and the other three members telescope.

17. A hand-held tag attacher as defined in claim 12, wherein the holding means includes a detent.

18. A hand-held tag attacher for attaching tags to merchandise using fasteners, each fastener having a bar section n and a button section joined by a filament section, the attacher comprising: an attacher body having a hopper adapted to receive a tack of tags and having a manually engageable handle, a needle 6 mounted to the body and having an elongate needle bore and an elongate side opening communicating with the needle bore, means for advancing one bar section at a time into alignment with the needle bore, a push rod engageable with a bar section of a fastener for driving the bar section through the needle bore while its filament section extends through the side opening, a tag feeder engageable with an endmost tag in the hopper for feeding the endmost tag from its position in the stack along a path to an attaching position in alignment with the needle, means for moving the bar section advancing means, the push rod and the tag feeder means through a cycle, means for movably the needle relative to the attacher body between a retracted position in which the needle is out of the path and an extended position in which the needle extends through the tag, means responsive to the actuating means for moving the tag feeder to move a tag from the hopper into alignment with the needle, for moving the needle through the tag, for moving the push rod to push the bar section through the needle bore, and for moving the bar section advancing means through a cycle, and means mounted on the body for retaining an additional tag adjacent the needle so that when the user operates the hand-held tag attacher the needle is driven through a tag fed by the tag feeder and through the additional tag held by the retaining means.

19. A hand-held tag attacher as defined in claim 18, wherein the retaining means includes a resilient member.

20. A hand-held tag attacher as defined in claim 18, wherein the retaining means includes a resilient clip.

* * * * *

UNITED STATES PATENT AND TRADEMARK OFFICE

CERTIFICATE OF CORRECTION

PATENT NO. : 4,690,317

DATED : September 1, 1987

INVENTOR(S) : Paul H. Hamisch, Jr. et al

It is certified that error appears in the above-identified patent and that said Letters Patent are hereby corrected as shown below:

Column 1, line 16, "009140" should be --0091410--. Column 4, line 62, after "vice versa" there should be a period --.--. Column 5, line 59, "180" should be --180'--; line 60, the apostrophe should be omitted. Column 10, line 40, claim 7, after the period "." delete the entire text through line 66. Column 11, line 3, claim 8, add the following text after "hopper" --adapted to receive a stack of tags and having a manually engageable handle, a needle mounted to the body and having an elongate needle bore and an elongate side opening communicating with the needle bore, means for advancing one bar section at a time into alignment with the needle bore, a push rod engageable with a bar section of a fastener for driving the bar section through the needle bore while its filament section extends through the side opening, a tag feeder engageable with an endmost tag in the hopper for feeding the endmost tag from its position in the stack along a path to an attaching position in alignment with the needle, means for moving the bar section advancing means, the push rod and the tag feeder means through a cycle, means for movably mounting the needle relative to the attacher body between a retracted position in which the needle is out of the path and an extended position in which the needle extends through the tag, means responsive to the actuating means for moving the tag feeder to move a tag from the hopper into alignment with the needle, for moving the needle through the tag, for moving the push rod to push the bar section through the needle bore, and for moving the bar section advancing means through a cycle, and a clip on the body adjacent the needle for retaining an additional tag through which the needle has been inserted by the user when it is desired to attach an additional tag to the merchandise.--. Column 11, line 7, there should be a colon --:-- after "comprising". Column 12,

UNITED STATES PATENT AND TRADEMARK OFFICE

CERTIFICATE OF CORRECTION

PATENT NO. : 4,690,317

DATED : September 1, 1987

INVENTOR(S) : Paul H. Hamisch', Jr. et al

It is certified that error appears in the above-identified patent and that said Letters Patent are hereby corrected as shown below:

continued - line 27, after "12" there should be a comma --,--; line 35, "n" should be deleted.

Signed and Sealed this

Second Day of February, 1988

*Attest:*

DONALD J. QUIGG

*Attesting Officer*

*Commissioner of Patents and Trademarks*